US007252245B2

(12) United States Patent
Nishiwaki

(10) Patent No.: US 7,252,245 B2
(45) Date of Patent: Aug. 7, 2007

(54) FUEL INJECTION VALVE

(75) Inventor: Toyoji Nishiwaki, Anjo (JP)

(73) Assignee: DENSO Corporation, Kariya, Aichi-pref. (JP)

( * ) Notice: Subject to any disclaimer, the term of this patent is extended or adjusted under 35 U.S.C. 154(b) by 272 days.

(21) Appl. No.: 11/142,290

(22) Filed: Jun. 2, 2005

(65) Prior Publication Data

US 2005/0269432 A1 Dec. 8, 2005

(30) Foreign Application Priority Data

Jun. 2, 2004 (JP) ..... 2004-164359
Feb. 18, 2005 (JP) ..... 2005-041934

(51) Int. Cl.
*B05B 1/30* (2006.01)
*F02M 47/02* (2006.01)
*F02M 59/00* (2006.01)
*F02M 61/00* (2006.01)

(52) U.S. Cl. ..... 239/88; 239/89; 239/90; 239/91; 239/92; 239/93; 239/533.2; 239/533.7; 239/533.12; 239/585.1; 239/585.2; 239/585.3; 239/585.4; 239/585.5

(58) Field of Classification Search ..... 239/88–93, 239/533.2, 533.7, 533.12, 585.1–585.5; 251/129.15, 251/129.21, 127
See application file for complete search history.

(56) References Cited

U.S. PATENT DOCUMENTS 4,315,491 A * 2/1982 Takeda ..... 123/478
4,773,374 A * 9/1988 Kiuchi et al. ..... 123/470
5,241,935 A * 9/1993 Beck et al. ..... 123/300
6,024,297 A * 2/2000 Greeves ..... 239/96
6,334,576 B1 * 1/2002 Cho ..... 239/5
6,367,769 B1 4/2002 Reiter
2003/0173424 A1 9/2003 Dentes et al.
2006/0192035 A1 8/2006 Petrone et al.

FOREIGN PATENT DOCUMENTS

DE 10118162 A1 10/2002
WO WO 2004/074673 9/2004

OTHER PUBLICATIONS

EPO Examination Report dated Oct. 27, 2006.
EPO Search Report dated May 20, 2006.
EPO Examination Report dated Mar. 31, 2006.
EPO Examination Report—Jan. 11, 2006.
EPO Search Report—Aug. 22, 2005.

* cited by examiner

*Primary Examiner*—Davis Hwu
(74) *Attorney, Agent, or Firm*—Nixon & Vanderhye P.C.

(57) ABSTRACT

A fuel injection valve includes a valve member, a first stop member, a second stop member, a movable core, a fixed core, and a coil. The valve member opens and closes an injection nozzle. The first stop member protrudes radially outward from said valve member. The second stop member protrudes radially outward from said valve member. The movable core is sandwiched between said first and second stop members. The movable core and one of said first and second stop members defines a fuel chamber. The fixed core is axially displaced from said movable core. The coil causes reciprocal axial displacement of said valve member such that said movable core axially reciprocates toward and away from said fixed core therewith.

14 Claims, 7 Drawing Sheets

FUEL INJECTION VALVE

CROSS REFERENCE TO RELATED APPLICATIONS

This application is based upon and claims the benefit of priority of Japanese Patent Application No. 2004-164359, filed on Jun. 2, 2004 and Japanese Patent Application No. 2005-41934, filed on Feb. 18, 2005, the contents of which are incorporated herein by reference.

FIELD OF THE INVENTION

The present invention relates to a fuel injection valve and, more particularly, a fuel injection valve having a movable core.

BACKGROUND OF THE INVENTION

In a conventional type of injector, a valve member formed as an integral part of a movable core is driven using magnetic attraction generated between a fixed core and the movable core in response to energization of a coil. In such an injector, the valve member moves back and forth in the axial direction according to whether or not the coil is energized. Consequently, when the movable core moves towards the fixed core, it collides with the fixed core, whereas when the movable core moves away from the fixed core, the integral valve member collides with the valve seat. As a result, the impact of the collisions causes so-called bouncing of the movable core and the valve member.

In an injector, bouncing of the valve member results in variation of opening time and closing time of the injection nozzle. This results in uncontrollable and irreproducible injection of fuel from the injection nozzle. The effect of bouncing is particularly marked when the length of the energizing pulse applied to the coil is small, making it impossible to precisely control the amount of fuel injected and the shape of the fuel spray. Accordingly, an injector has been proposed in which two stoppers are provided on the valve member, with the movable core disposed between these stoppers (see Published Japanese Translation of PCT application No. 2002-528672).

In the injector disclosed in the Published Japanese Translation of PCT application No. 2002-528672, the movable core is able to move in the axial direction between the two stoppers. Consequently, when the valve member collides with another member, opposing inertial forces are generated in the valve member and the movable core. This moderates the impact force at the point of collision. In addition, by providing buffer springs between the movable core and the stoppers, the impact of the collisions is moderated, and the occurrence of bouncing is reduced.

However, with the technology disclosed in the Published Japanese Translation of PCT application No. 2002-528672, two stoppers must be provided in the valve member, and the movable core must be interposed between the two stoppers in such a manner as to be movable relative to the valve member. In addition, buffer springs must be provided between the movable core and the stoppers. This leads to a more complicated construction and increases the some number of components. Furthermore, long term operation of the injector can cause spring fatigue and abrasion and the like. Consequently, the characteristics of the springs vary over time, and it is difficult to ensure stable fuel injection characteristics over an extended period.

SUMMARY OF THE INVENTION

Accordingly, an object of the present invention is to provide an injector which uses a simple construction to reduce bouncing of the movable core and the valve member, with increasing the minimum number of components, and which displays little variation in fuel injection characteristics over its lifetime.

In one aspect of the invention, the movable core is sandwiched between stop members provided on the valve member, forming a fuel chamber between the movable core and the stop members. Consequently, the fuel that collects in the fuel chamber formed between the movable core and the stop members functions as a damper, which moderates the impact between the movable core and the stop members. Thus, it is not necessary to provide stopper or buffer springs, and bouncing of the movable core, as well as the valve member on which the stop members are provided, can be reduced using a simple construction, with increasing the minimum number of components. Furthermore, the damping effect of the fuel in the fuel chamber does not vary greatly over time. Accordingly, variation in the fuel injection characteristics can be minimized.

In another aspect of the present invention, the movable core has a cylindrical portion protruding towards the injection side, and one of the stop members forms a fuel chamber in combination with this cylindrical portion. Consequently, a separate member is not required to form the fuel chamber. Accordingly, bouncing of the movable core and the valve member can be reduced using a simple construction, with increasing the minimum number of components.

In another aspect of the present invention, a fuel aperture is formed between the outside edge in the radial direction of the stop member and the inner circumferential surface of the cylindrical portion. This fuel aperture restricts the flow of fuel in and out of the fuel chamber. Consequently, by adjusting the surface area of the opening of the fuel aperture formed between the stop member and the cylindrical portion, the flow rate of fuel in and out of the fuel chamber can be controlled easily. As a result, the surface area of the opening of the fuel aperture controls the damping effect of the fuel in the fuel chamber. Accordingly, it is possible to easily control and reduce bouncing in accordance with the operating characteristics of the valve member and the movable core, and the fuel injection characteristics that are required.

In still another aspect of the present invention, the stop member has an aperture portion that penetrates through the stop member in the through-thickness direction. This aperture portion is either a cylindrical hole that passes through the stop member, or a notch-shaped groove formed at the radial outer edge of the stop member. This aperture portion restricts the flow of fuel in and out of the fuel chamber. Consequently, by adjusting the surface area of the opening of this aperture portion, the flow rate of fuel in and out of the fuel chamber can be controlled easily. As a result, the characteristics of the damping effect produced by the fuel in the fuel chamber are controlled by the surface area of the opening of the aperture portion. Accordingly, it is possible to easily control and reduce bouncing in accordance with the operating characteristics of the valve member and the movable core, and the fuel injection characteristics that are required.

In still another aspect of the present invention, the movable core has an injection side recess, recessed away from the injection nozzle, in an end portion at an injection side of the movable core, and one of the stop members forms the fuel chamber together with this injection side recess. Thus, a separate member is not required to form the fuel chamber. Accordingly, bouncing of the movable core and the valve member can be reduced using a simple construction, with increasing the minimum number of components.

In still another aspect of the present invention, a fuel aperture is formed between the outside edge in the radial direction of the stop member and the inner circumferential surface of the injection side recess. This fuel aperture restricts the flow of fuel in and out of the fuel chamber. Consequently, by adjusting the surface area of the opening of the fuel aperture formed between the stop member and the injection side recess, the flow rate of fuel in and out of the fuel chamber can be controlled easily. As a result, the surface area of the opening of the fuel aperture controls the damping effect of the fuel in the fuel chamber. Accordingly, it is possible to easily control and reduce bouncing in accordance with the operating characteristics of the valve member and the movable core, and the fuel injection characteristics that are required.

In still another aspect of the present invention, the stop member has an aperture portion that penetrates through the stop member in the through-thickness direction. This aperture portion is either a cylindrical hole that passes through the stop member, or a notch-shaped groove formed at the radial outer edge of the stop member. This aperture portion restricts the flow of fuel in and out of the fuel chamber. Consequently, by adjusting the surface area of the opening of this aperture portion, the flow rate of fuel in and out of the fuel chamber can be controlled easily. As a result, the characteristics of the damping effect produced by the fuel in the fuel chamber are controlled by the surface area of the opening of the aperture portion. Accordingly, it is possible to easily control and reduce bouncing in accordance with the operating characteristics of the valve member and the movable core, and the fuel injection characteristics that are required.

In still another aspect of the present invention, the movable core has a non-injection side recess, recessed towards the injection side, in the end portion of the movable core on the opposite side from the injection side. The non-injection side recess forms the fuel chamber with an end stop member. The end stop member is the one provided at the opposite end of the valve member from the injection nozzle. Thus, a separate member is not required to form the fuel chamber. Accordingly, bouncing of the movable core and the valve member can be reduced using a simple construction, with increasing the minimum number of components.

In still another aspect of the present invention, the base of the movable core and the opposing face of the end stop member, which oppose each other, are both flat surfaces. Consequently, a so-called squeezing force occurs between the opposing face and the base. Accordingly, bouncing of the movable core and the valve member can be reduced using a simple construction, with increasing the minimum number of components.

In still another aspect of the present invention, the end face of the movable core and the end face of the stop member, which face each other, form the fuel chamber. Consequently, there is no need to form a recess or the like in the movable core, for example. This further simplifies the shape and manufacture of the movable core. Furthermore, when the movable core and the stop member move apart, the fuel in the fuel chamber formed between the movable core and the stop member generates a squeezing force that acts to prevent them from moving apart. In addition, when the movable core and the stop member collide, the fuel in the fuel chamber generates a damping force that moderates the impact of the collision. Accordingly, bouncing of the movable core and the valve member can be reduced using a simple construction.

In still another aspect of the present invention, fuel flows in and out of the fuel chamber past the radial outer edge of an end face of the movable core and an end face of the stop member. Consequently, by adjusting the distance between the end face of the movable core and the end face of the stop member at the radial outside edge of the movable core, the flow rate of fuel in and out of the fuel chamber can be controlled easily. Accordingly, it is possible to easily control and reduce bouncing in accordance with the operating characteristics of the valve member and the movable core, and the fuel injection characteristics that are required.

In still another aspect of the present invention, fuel passages are formed on the inner circumferential side of the valve member. Thus, fuel from the fixed core side passes through the inside of the valve member. Furthermore, by forming these fuel passages, the valve member takes the form of a cylinder. Consequently, the weight of the valve member is reduced, which improves the responsiveness of the valve member to coil energization.

In still another aspect of the present invention, the valve member and the movable core are capable of relative movement in the axial direction. Consequently, when the movable core and the fixed core collide, the valve member has an inertial force which acts to keep the valve member moving in the direction of the fixed core. In contrast, the impact of the collision gives the movable core an inertial force in the opposite direction to the fixed core. In this case, because the movable core and the valve member form the fuel chamber, the opposing inertial forces of the movable core and the valve member are absorbed by the damping effect of the fuel in the fuel chamber. Thus, when the movable core and the fixed core collide, the impact force at the point of collision is moderated. Furthermore, in a similar manner, when the movable core and the valve member move away from the fixed core, and the valve member collides with the valve seat, the impact force at the point of collision is moderated. Accordingly, bouncing of the movable core and the valve member can be reduced using a simple construction, with increasing the minimum number of components.

Other features and advantages of the present invention will be appreciated, as well as methods of operation and the function of the related parts from a study of the following detailed description, appended claims, and drawings, all of which form a part of this application. In the drawings:

DETAILED DESCRIPTION OF THE PREFERRED EMBODIMENTS

A plurality of embodiments of the present invention are described below with reference to the drawings.

Figure 2:
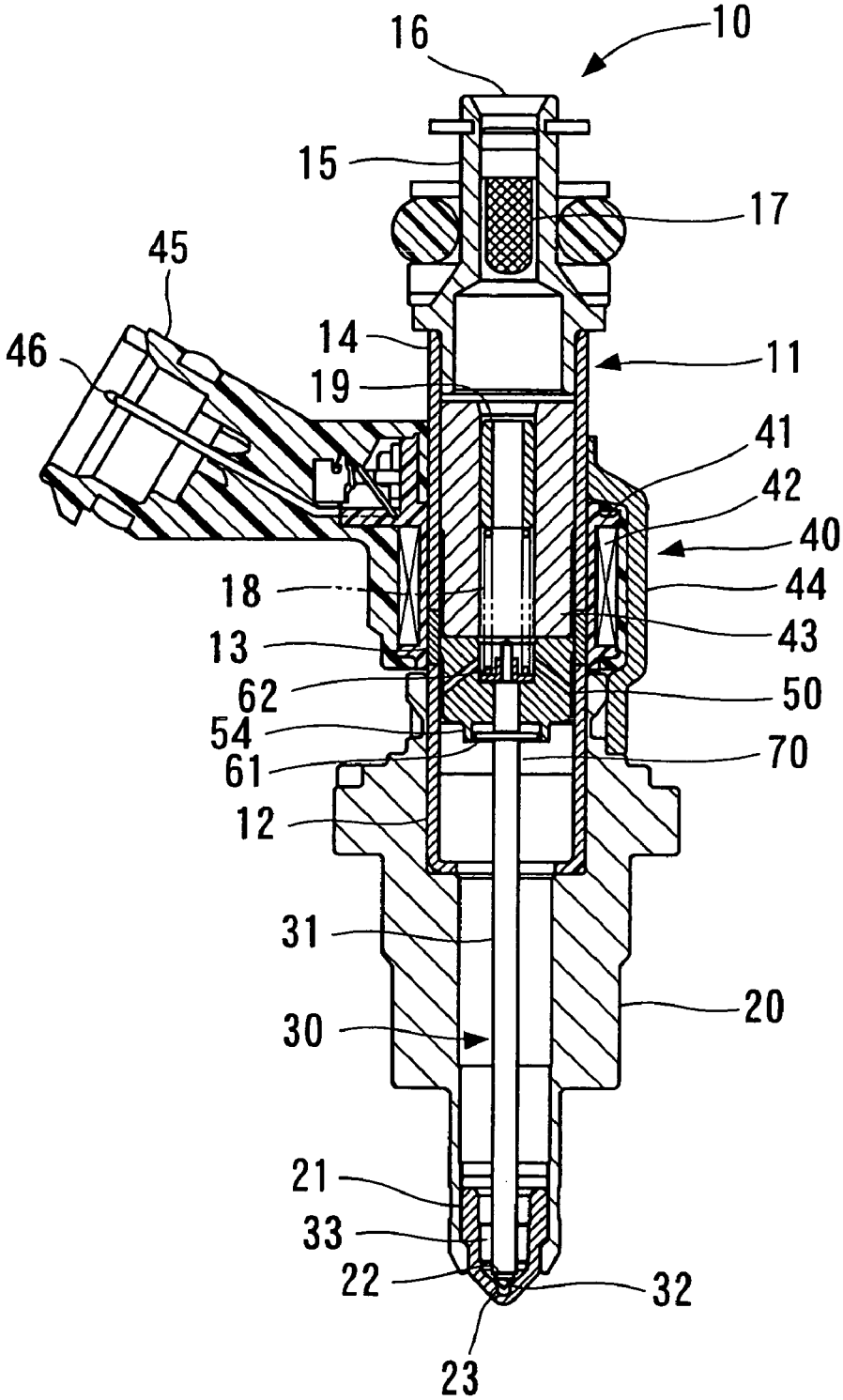
FIG. 2 is a cross-sectional view of an injector according to the first embodiment of the present invention.

FIG. 2 shows a fuel injection valve (hereafter, referred to as an "injector") according to a first embodiment of the present invention. An injector 10 of the first embodiment can be applied to direct-injection gasoline engines, for example. However, the injector 10 is not limited to applications within direct-injection gasoline engines, and may also be applied to premixing type gasoline engines or diesel engines. When applied to a direct-injection gasoline engine, the injector 10 is fitted to a cylinder head, not shown in the diagrams.

A housing 11 of the injector 10 is formed as a cylinder. The housing 11 comprises a first magnetic portion 12, a non-magnetic portion 13, and a second magnetic portion 14. The non-magnetic portion 13 prevents magnetic shorting of the first magnetic portion 12 and the second magnetic portion 14. The first magnetic portion 12, the non-magnetic portion 13, and the second magnetic portion 14 are connected together by laser welding or the like to form a single integrated body. It is also possible to mold the housing 11 from a magnetic material as an integrated cylindrical product, and then demagnetize the portion corresponding to the non-magnetic portion 13 using a heat treatment.

An inlet member 15 is provided at one end in the axial direction of the housing 11. The inlet member 15 is press-fit inside the inner circumference of the housing 11. The inlet member 15 has a fuel inlet 16. Fuel is supplied to the fuel inlet 16 from a fuel pump, not shown in the figure. The fuel supplied to the fuel inlet 16 flows into the inside of the housing 11 through a fuel filter 17. The fuel filter 17 removes foreign matters from the fuel.

A nozzle holder 20 is provided at the other end of the housing 11. The nozzle holder 20 is formed in the shape of a cylinder, on the inside of which is provided a nozzle body 21. The nozzle body 21 is also in the form of a cylinder, and is fixed to the nozzle holder 20 by a method such as press-fitting or welding, for example. The nozzle body 21 has a valve seat 22, which is formed on a conically shaped internal surface, the inside diameter of which narrows towards the tip. The nozzle body 21 has an injection nozzle 23 positioned at the tip on the opposite side from the housing 11, and this nozzle passes through the nozzle body 21 and connects the inside wall of the nozzle body with the outside wall.

A needle 30, which functions as the valve member, is housed inside the housing 11, the nozzle holder 20 and the nozzle body 21, and is able to move back and forth in the axial direction. The needle 30 is positioned substantially coaxially with the nozzle body 21. The needle 30 has a shaft portion 31 and a seal portion 32. The seal portion 32 is provided at the opposite end of the shaft portion 31 from the fuel inlet 16. The seal portion 32 is capable of contacting the valve seat 22 provided in the nozzle body 21. The needle 30 forms a fuel passage 33 through to the nozzle body 21, through which fuel flows.

The injector 10 has an actuator 40 that drives the needle 30. The actuator 40 comprises a spool 41, a coil 42, a fixed core 43, a plate housing 44, and a movable core 50. The spool 41 is positioned outside the housing 11. The spool 41 is formed from resin in a cylindrical shape, and the coil 42 is then wound around the outside of the spool 41. The coil 42 is connected to a terminal 46 of a connector 45. The fixed core 43 is disposed inside the coil 42, with the housing 11 sandwiched therebetween. The fixed core 43 is formed in a cylindrical shape from a magnetic material such as iron, and is fixed to the inside of the housing 11 by press-fitting, for example. The plate housing 44 is also made of a magnetic material, and covers the outside circumference of the coil 42.

The movable core 50 is provided inside the housing 11, in a manner that enables movement back and forth in the axial direction. The movable core 50 is formed in a cylindrical shape from a magnetic material such as iron. At the end of the movable core 50 on the side of the fixed core 43, the movable core 50 contacts a spring 18, which acts as energizing means. One end of this spring 18 contacts the movable core 50, and the other end contacts an adjusting pipe 19 which is press-fit into the fixed core 43. The spring 18 applies a force that extends along the axial direction. Consequently, the movable core 50 and the needle 30 are pushed by the spring 18 towards the seating position on the valve seat 22. The load of the spring 18 can be controlled by adjusting the degree to which the adjusting pipe 19 is press-fit into the fixed core 43. When the coil 42 is not energized, the movable core 50 and the needle 30 are pushed against the valve seat 22, and the seal portion 32 is seated against the valve seat 22.

Next, the movable core 50 of the actuator 40, and the needle 30 are described in further detail.

Figure 1:
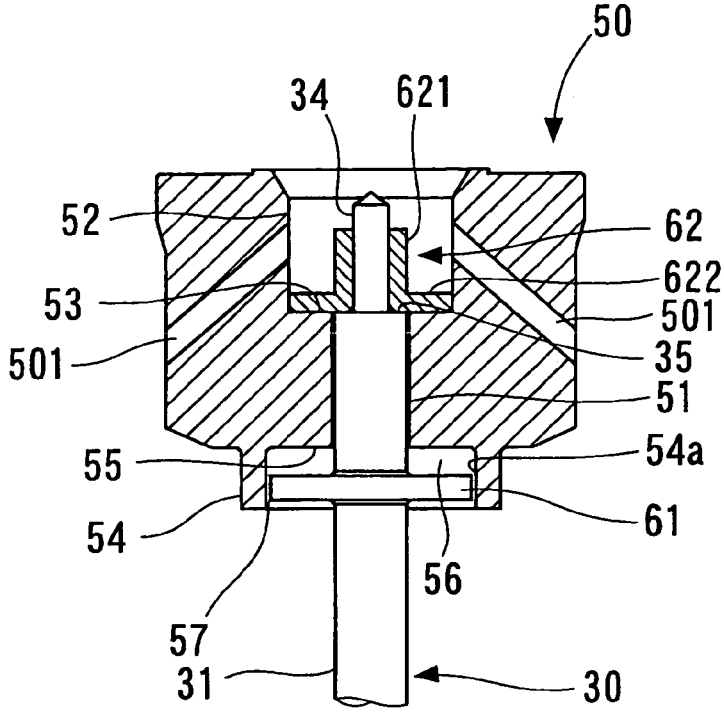
FIG. 1 is a cross-sectional view showing the vicinity around a movable core of an injector according to the first embodiment of the present invention.

The needle 30 is inserted into the movable core 50 in a manner that enables movement back and forth in the axial direction. As shown in FIG. 1, the movable core 50 has a hole 51 which passes through the radial center of the movable core 50 in the axial direction. The fixed core 43 side of the hole 51 connects to a recess 52. The recess 52 is recessed from the fixed core 43 side of the movable core 50, that is, from the end of the movable core 50 on the opposite side from the injection nozzle 23, towards the injection nozzle 23. The inside diameter of the recess 52 is larger than that of the hole 51. Consequently, a ring-shaped stepped portion 53 is formed between the hole 51 and the recess 52. Here, the recess 52 corresponds to the non-injection side recess in the claims, and the stepped portion 53 corresponds to the base described in the claims. Furthermore, at the end of the movable core 50 on the opposite side from the fixed core 43, that is, the injection nozzle 23 end of the movable core 50, a cylindrical portion 54 is provided that protrudes towards the injection nozzle 23. Both the inside and outside diameter of this cylindrical portion 54 are larger than the hole 51. Consequently, a ring-shaped stepped portion 55 is formed between the hole 51 and the cylindrical portion 54. Furthermore, the outside diameter of the cylindrical portion 54 is typically smaller than that of the movable core 50, although may also be substantially the same as that of the movable core 50. Fuel passages 501 which link the inner circumferential surface of the movable core 50 that forms the recess 52 to the outer circumferential surface are formed in the cylindrical movable core 50. A plurality of these fuel passages 501 are formed around the circumferential direction of the movable core 50.

A first stop member 61 and a second stop member 62 are provided on the shaft portion 31 of the needle 30. The first and second stop members 61 and 62 are positioned apart from each other along the axial direction of the needle 30. The movable core 50 is sandwiched between the first and second stop members 61 and 62. The inside diameter of the hole 51 of the movable core 50 is slightly larger than the outside diameter of the shaft portion 31 of the needle 30. Thus, the needle 30 and the movable core 50 are capable of relative movement in the axial direction.

The first stop member 61 is positioned closer to the injection nozzle 23 than the second stop member 62. The first stop member 61 protrudes outward in a radial direction from the shaft portion 31 of the needle 30. The first stop member 61 is formed as part of a single integrated body with the needle 30. The first stop member 61 protrudes from the needle 30 in a continuous ring shape in the circumferential direction.

On the other hand, the second stop member 62 is positioned further away from the injection nozzle 23 than the first stop member 61. In other words, the second stop member 62 is an end stop member provided at the opposite end of the needle 30, in the axial direction, from the seal portion 32. The second stop member 62 protrudes outward in a radial direction from the shaft portion 31 of the needle 30. The second stop member 62 is formed as a separate body from the needle 30. The second stop member 62 is press-fit onto a small-diameter portion 34 formed at the opposite end of the needle 30 from the injection nozzle 23. The second stop member 62 comprises a press-fitting portion 621, which is press-fit onto the small-diameter portion 34 of the needle 30, and a protruding portion 622, which protrudes in a radial direction from the press-fitting portion 621, forming a continuous ring shape. The position of the second stop member 62 along the axial direction is determined by a step 35 formed between the shaft portion 31 of the needle 30 and the small-diameter portion 34. The end of the spring 18 positioned away from the adjusting pipe 19 contacts the protruding portion 622 of the second stop member 62, thereby pushing the movable core 50 in the direction of the injection nozzle 23.

The needle 30 is inserted into the movable core 50 from the opposite side of the movable core 50 to the fixed core 43, and the second stop member 62 is attached to the needle 30. As a result, the movable core 50 is sandwiched between the first stop member 61 and the second stop member 62. When the second stop member 62 is in contact with the stepped portion 53 of the movable core 50, a gap of a predetermined length forms between the first stop member 61 and the stepped portion 53 of the movable core 50. Thus, the needle 30 and the movable core 50 are able to undergo relative movement in the axial direction, equivalent to the length of this gap.

When the needle 30 and the movable core 50 undergo relative movement in the axial direction, the first stop member 61 moves back and forth in the axial direction inside the cylindrical portion 54 of the movable core 50. Consequently, a fuel chamber 56 is formed between the stepped portion 55 of the movable core 50, an inner circumferential surface 54*a* of the cylindrical portion 54, and the surface of the first stop member 61 that faces the fixed core 43. When axial movement of the needle 30 and the movable core 50 causes the first stop member 61 to move back and forth inside the cylindrical portion 54, the capacity of the fuel chamber 56 changes. The outside diameter of the first stop member 61 is slightly smaller than the inside diameter of the cylindrical portion 54. Consequently, when the capacity of the fuel chamber 56 changes, fuel enters and leaves the fuel chamber 56 through the slight gap formed between the radial outer edge of the first stop member 61 and the inner circumferential surface 54*a* of the cylindrical portion 54. In other words, the radial outer edge of the first stop member 61 and the inner circumferential surface 54*a* of the cylindrical portion 54 form an aperture portion 57, which functions as a fuel aperture for restricting the flow of fuel in and out of the fuel chamber 56.

The gap between the inner circumferential surface of the movable core 50, which forms the hole 51, and the outer wall of the needle 30, is smaller than the aperture portion 57. Consequently, fuel enters and leaves the fuel chamber 56 through the aperture portion 57 formed between the first stop member 61 and the cylindrical portion 54.

Figure 3:
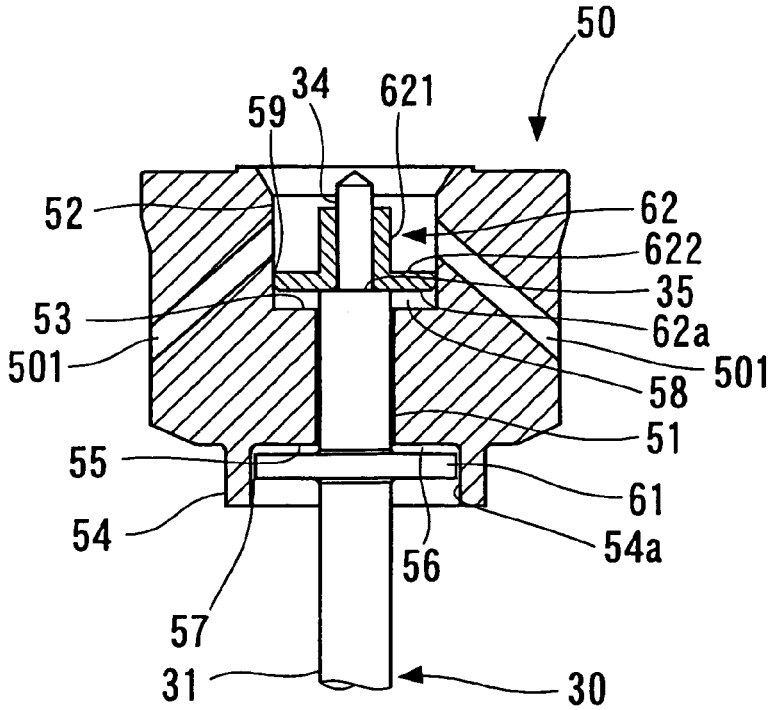
FIG. 3 is a cross-sectional view showing the vicinity around the movable core of the injector according to the first embodiment of the present invention, wherein a second stop member and the movable core are separated.

When the needle 30 and the movable core 50 undergo relative movement in the radial direction, the second stop member 62 moves back and forth in the axial direction inside the recess 52 of the movable core 50. Consequently, as shown in FIG. 3, a fuel chamber 58 is formed between the stepped portion 53 of the movable core 50, the inner circumferential surface of the movable core 50 that forms the recess 52, and an opposing face 62*a*, which is the surface of the second stop member 62 on the side of the stepped portion 53. When the axial movement of the needle 30 and the movable core 50 causes the second stop member 62 to move back and forth inside the recess 52, the capacity of the fuel chamber 58 changes. The outside diameter of the second stop member 62 is slightly smaller than the inside diameter of the recess 52. Thus, when the capacity of the fuel chamber 58 changes, fuel enters and leaves the fuel chamber 58 through the tiny gap formed between the radial outer edge of the second stop member 62, and the inner circumferential surface of the movable core 50 that forms the recess 52. In other words, the radial outer edge of the second stop member 62, and the inner circumferential surface of the movable core 50 that forms the recess 52, form an aperture portion 59, which functions as a fuel aperture for restricting the flow of fuel in and out of the fuel chamber 58. The stepped portion 53 of the movable core 50 and the opposing face 62*a* of the second stop member 62 are both flat. Thus, when relative movement of the needle 30 and the movable core 50 causes the opposing face 62*a* to move away from the stepped portion 53, a mutually attracting force, that is, a squeezing force, occurs between the opposing face 62*a* and the stepped portion 53.

Next, the impact moderating effect of the injector 10 according to the above construction is described.

When the movable core 50 is drawn towards the fixed core 43, leading to a collision between the fixed core 43 and the movable core 50, the impact of the collision causes the movable core 50 to move away from the fixed core 43, that is, towards the injection nozzle 23. On the other hand, when the fixed core 43 and the movable core 50 collide, an inertial force means the needle 30 has energy moving towards the fixed core 43. This means that while the movable core 50 has movement energy directed in the opposite direction to the fixed core 43, the needle 30 has movement energy directed towards the fixed core 43. In other words, the energy of the movable core 50 and the energy of the needle 30 are acting in opposite directions. As a result, by allowing relative movement of the movable core 50 and the needle 30, the kinetic energy produced in the movable core 50 and the needle 30 when the fixed core 43 and the movable core 50 collide can be canceled out.

A collision between the fixed core 43 and the movable core 50 causes the movable core 50 to move away from the fixed core 43, while the needle 30 moves towards the fixed core 43. In this case, the movement of the first stop member 61 that accompanies the movement of the needle 30 causes a reduction in the capacity of the fuel chamber 56. Consequently, the fuel in the fuel chamber 56 is pressurized, and the pressurized fuel is discharged slowly from the fuel chamber 56, through the aperture portion 57. This causes the fuel in the fuel chamber 56 to generate a damping effect.

In the same manner, the movement of the second stop member 62 that accompanies the movement of the needle 30 causes the capacity of the fuel chamber 58 to increase. Consequently, the pressure of the fuel in the fuel chamber 58 is reduced, and fuel is slowly drawn into the fuel chamber 58 through the aperture portion 59. Furthermore, a squeezing force is generated between the second stop member 62 and the movable core 50. This causes the fuel in the fuel chamber 58 to generate a damping effect. Therefore, the impact of the collision between the movable core 50 and the fixed core 43 is absorbed by relative movement of the movable core 50 and the needle 30, as well as the damping effect provided by the fuel chamber 56 and the fuel chamber 58. As a result, bouncing of the movable core 50, and the needle 30 which moves in concert with the movable core 50, is reduced.

Furthermore, when the pushing force of the spring 18 causes the seal portion 32 of the needle 30 to be seated on the valve seat 22, the impact at the time of seating causes the needle 30 to move in the direction of the fixed core 43. On the other hand, when the seal portion 32 and the valve seat 22 collide, the inertial force produced means the movable core 50 has energy moving in the opposite direction to the fixed core 43, that is in the direction of the injection nozzle 23. This means that while the needle 30 has energy moving in the fixed core 43 direction, the movable core 50 has energy moving in the opposite direction. As a result, by allowing relative movement of the movable core 50 and the needle 30, the kinetic energy produced in the movable core 50 and the needle 30 when the needle 30 and the valve seat 22 collide can be canceled out.

When the needle 30 and the valve seat 22 collide, the needle 30 moves in the direction of the fixed core 43 while the movable core 50 moves in the opposite direction to the fixed core 43. In this case, the movement of the first stop member 61 that accompanies the movement of the needle 30 reduces the capacity of the fuel chamber 56. Consequently, the fuel in the fuel chamber 56 is pressurized, and the pressurized fuel is discharged slowly from the fuel chamber 56, through the aperture portion 57. This causes the fuel in the fuel chamber 56 to generate a damping effect.

In the same manner, the movement of the second stop member 62 that accompanies the movement of the needle 30 causes the capacity of the fuel chamber 58 to increase. Consequently, the pressure of the fuel in the fuel chamber 58 is reduced, and fuel is slowly drawn into the fuel chamber 58 through the aperture portion 59. Furthermore, a squeezing force is generated between the second stop member 62 and the movable core 50. This causes the fuel in the fuel chamber 58 to generate a damping effect. Therefore, the impact of the collision between the needle 30 and the valve seat 22 is absorbed by relative movement of the movable core 50 and the needle 30, as well as the damping effect provided by the fuel chamber 56 and the fuel chamber 58. As a result, bouncing of the movable core 50, and the needle 30, which moves in concert with the movable core 50, is reduced.

Next, the operation of the injector 10 according to the above construction is described.

When energization of the coil 42 is stopped, there is no magnetic attraction generated between the fixed core 43 and the movable core 50. Consequently, the pushing force of the spring 18 causes the movable core 50 and the needle 30 to move in the opposite direction to the fixed core 43. As a result, when energization of the coil 42 is stopped, the seal portion 32 of the needle 30 is seated on the valve seat 22. Accordingly, no fuel is injected from the injection nozzle 23.

When the coil 42 is energized, the magnetic field produced in the coil 42 causes a magnetic flux to flow through the plate housing 44, the first magnetic portion 12, the movable core 50, the fixed core 43, and the second magnetic portion 14, thereby forming a magnetic circuit. Accordingly, magnetic attraction is generated between the fixed core 43 and the movable core 50. When this magnetic attraction generated between the fixed core 43 and the movable core 50 exceeds the pushing force generated by the spring 18, the movable core 50 moves towards the fixed core 43. At this time, the second stop member 62 provided on the needle 30 contacts the stepped portion 53 of the movable core 50. Consequently, the needle 30 also moves in the direction of the fixed core 43, together with the movable core 50. As a result, the seal portion 32 of the needle 30 is unseated from the valve seat 22.

The fuel which flows into the injector 10 from the fuel inlet 16 travels via the fuel filter 17, the inside of the inlet member 15, the inside of the adjusting pipe 19, the fuel passages 501 of the movable core 50, and the inside of the nozzle holder 20, before entering the fuel passage 33. The fuel which flows into the fuel passage 33 flows into the injection nozzle 23 through the gap formed between the needle 30, which has been unseated from the valve seat 22, and the nozzle body 21. Fuel is thus injected from the injection nozzle 23.

When energization of the coil 42 is stopped, the magnetic attraction between the fixed core 43 and the movable core 50 dissipates. Because the second stop member 62 is in contact with the stepped portion 53 of the movable core 50, the pushing force of the spring 18 causes the movable core 50 and the needle 30 to move away from the fixed core 43 as a unit. Consequently, the seal portion 32 is once again seated on the valve seat 22, and the flow of fuel between the fuel passage 33 and the injection nozzle 23 is cut off. Accordingly, fuel injection stops.

As described above, in the first embodiment, the movable core 50 and the needle 30 are freely movable relative to each other over a predetermined range in the axial direction. Consequently, bouncing of the movable core 50, which occurs when the fixed core 43 and the movable core 50 collide, is absorbed by the inertial movement of the needle 30 in the direction opposite to the bouncing. Furthermore, bouncing of the needle 30, which occurs when the needle 30 collides with the valve seat 22, is absorbed by the inertial movement of the movable core 50 in the direction opposite to the bouncing. In addition, the relative movement between the needle 30 and the movable core 50 is moderated by the damping effect of the fuel in the fuel chambers 56 and 58 formed between the first stop member 61 or the second stop member 62 respectively, and the movable core 50. Thus, the impact of a collision is moderated, while still ensuring that the needle 30 and the movable core 50 move as a unit. Accordingly, bouncing during operation of the needle 30 and the movable core 50 can be reduced using a simple construction, with increasing the minimum number of components.

Particularly in those cases where the present invention is applied to a direct-injection gasoline engine, as with the injector 10 of the present embodiment, the pressure of the fuel injected from the injector 10 will be high, within a range from 5 to 13 MPa. Recently, higher fuel pressures have been demanded in order to better atomize the injected fuel. When the fuel pressure is increased, greater drive force is required of the actuator 40 to open the valve, that is increased magnetic attraction is required between the fixed core 43 and the movable core 50. On the other hand, to close the valve, increased pushing force is required of the spring 18, which functions as the energizing means. Consequently, the impact of collisions between the movable core 50 and the fixed core 43 when opening the valve of the needle 30, and the impact of collisions between the needle 30 and the valve seat 22 when closing the valve of the needle 30, both increase. On the other hand, with the injector 10 of the present embodiment, because the impact of the collisions is moderated, bouncing during operation is reduced. Thus, uncontrollable injection of fuel from the injector 10 is reduced. Accordingly, the amount of fuel injected from the injection nozzle 23 and the shape of the spray can be controlled with favorable precision, even if the fuel pressure is increased.

Furthermore, in the injector 10 of the first embodiment, fuel enters and leaves the fuel chamber 56 through the aperture portion 57, and the fuel chamber 58 through the aperture portion 59. Accordingly, the characteristics of the damping effects produced by the fuel chambers 56 and 58 can be changed by adjusting either the gap between the first stop member 61 and the cylindrical portion 54, which forms the aperture portion 57, or the gap between the second stop member 62 and the inner circumferential surface of the movable core 50, which forms the aperture portion 59, respectively. Accordingly, the characteristics of the damping effects produced by the fuel within the fuel chambers 56 and 58 can be adjusted easily, and bouncing of the needle 30 can be minimized.

In addition, in the injector 10 of the first embodiment, the impact of a collision during operation of the needle 30 is moderated by the relative movement of the needle 30 and the movable core 50, and the damping effect provided by the fuel in the fuel chambers 56 and 58. This damping effect is generated by the fuel within the fuel chambers 56 and 58. Consequently, there is almost no variation over time in this damping effect, especially when compared with the moderating effect provided by an elastic member such as a spring. Accordingly, there is little variation in the impact moderating capabilities, meaning the injector 10 can demonstrate stable fuel injection characteristics over long periods.

Figure 4:
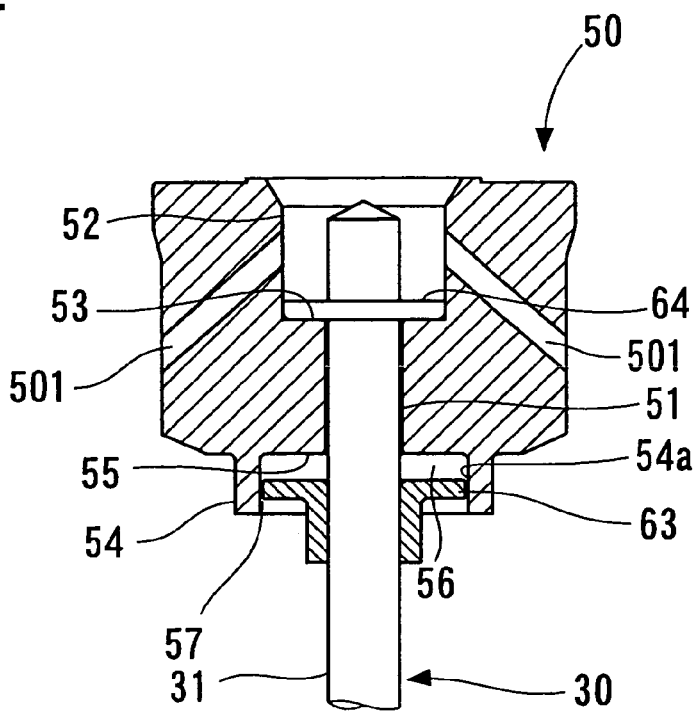
FIG. 4 is a cross-sectional view showing a first modification of the injector according to the first embodiment of the present invention.
Figure 5:
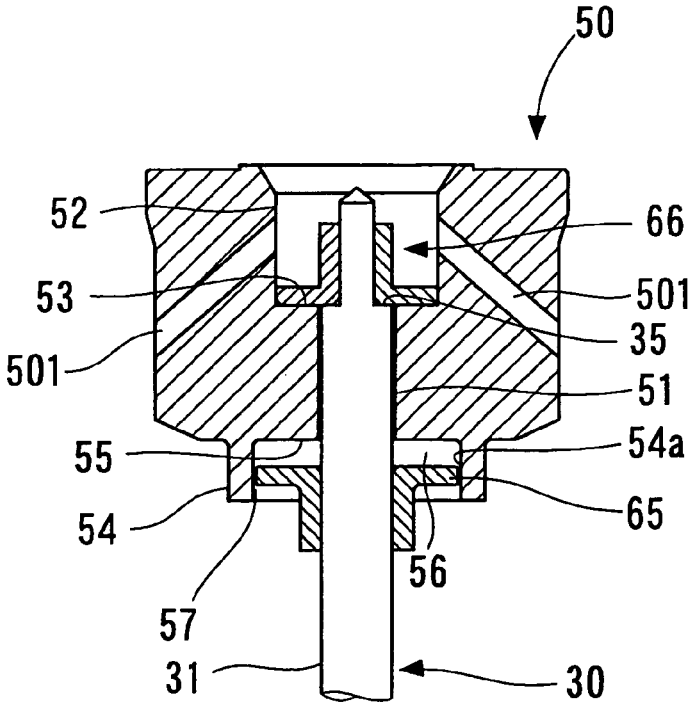
FIG. 5 is a cross-sectional view showing a second modification of the injector according to the first embodiment of the present invention.

Modifications of the injector according to the first embodiment of the present invention are shown in FIG. 4 and FIG. 5. Those structural elements that are substantially the same as in the first embodiment are given the same reference numerals, and their description is omitted.

In the modification shown in FIG. 4, a first stop member 63 is formed as a separate body from the needle 30. On the other hand, a second stop member 64 is formed integrally with the needle 30.

Furthermore, in the modification shown in FIG. 5, both a first stop member 65 and a second stop member 66 are formed as separate bodies from the needle 30.

Figure 6:
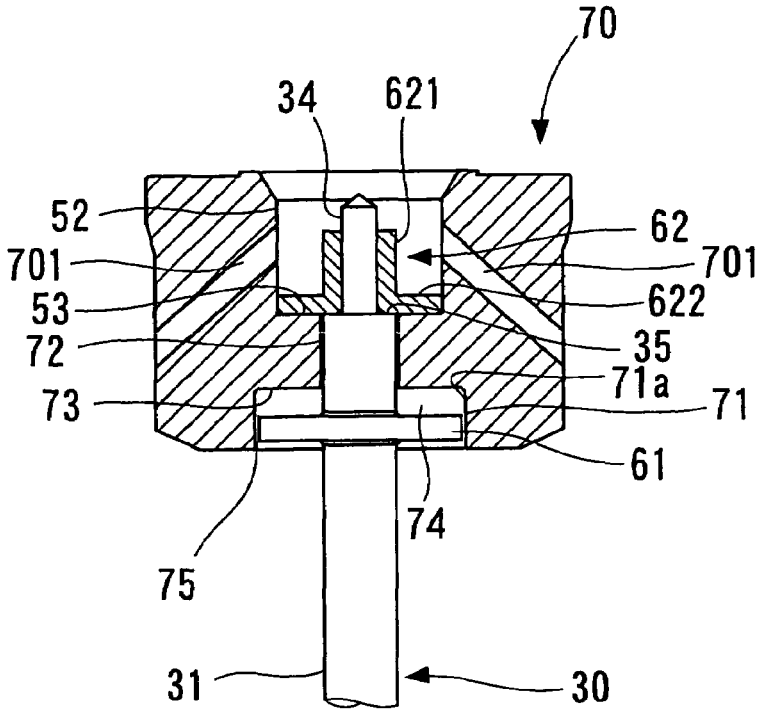
FIG. 6 is a cross-sectional view showing the vicinity around a movable core of an injector according to a second embodiment of the present invention.

The vicinity around the movable core of an injector according to a second embodiment of the present invention is shown in FIG. 6. Those structural elements that are substantially the same as in the first embodiment are given the same reference numerals, and their description is omitted.

As shown in FIG. 6, a movable core 70 of the injector according to the second embodiment has a recess 71 at the opposite end from the fixed core 43. The recess 71 is recessed towards the fixed core 43. This recess 71 corresponds to the injection side recess in the claims. The inside diameter of the recess 71 is greater than that of a hole portion 72. Consequently, a stepped portion 73 is formed between the recess 71 and the hole portion 72. Furthermore, the movable core 70 comprises fuel passages 701 which connect the inside of the movable core 70 with the outside.

During relative movement of the needle 30 and the movable core 70 in the axial direction, the first stop member 61, which is integrated with the needle 30, moves axially back and forth inside the recess 71. Consequently, a fuel chamber 74 is formed between the stepped portion 73 of the movable core 70, the inner circumferential surface of the movable core 70 that forms the recess 71, and the surface of the first stop member 61 on the side of the fixed core 43. When axial movement of the needle 30 and the movable core 70 causes the first stop member 61 to move back and forth inside the recess 71, the capacity of the fuel chamber 74 changes. The inside diameter of the recess 71 is slightly larger than the outside diameter of the first stop member 61. Thus, when the capacity of the fuel chamber 74 changes, fuel enters and leaves the fuel chamber 74 through the small gap formed between the radial outer edge of the first stop member 61, and an inner circumferential surface 71*a* of the movable core 70 that forms the recess 71. In other words, the radial outer edge of the first stop member 61 and the inner circumferential surface 71*a* of the movable core 70 form an aperture portion 75, which acts as a fuel aperture for restricting the flow of fuel in and out of the fuel chamber.

In the second embodiment, the fuel chamber 74 is formed in the recess 71, which is recessed into the end portion of the movable core 70 on the opposite side from the fixed core 43. In the construction of the second embodiment, as in the first embodiment, the fuel in the fuel chamber 74 has a damping effect. Consequently, relative movement between the needle 30 and the movable core 70 is moderated by the damping effect of the fuel in the fuel chamber 74 formed between the first stop member 61, which is formed integrally with the needle 30, or the second stop member 62, and the movable core 50. Thus, the impact of a collision is moderated, while still ensuring that the needle 30 and the movable core 70 move as a unit. Accordingly, bouncing during operation of the needle 30 and the movable core 70 can be reduced using a simple construction, with increasing the minimum number of components.

Figure 7:
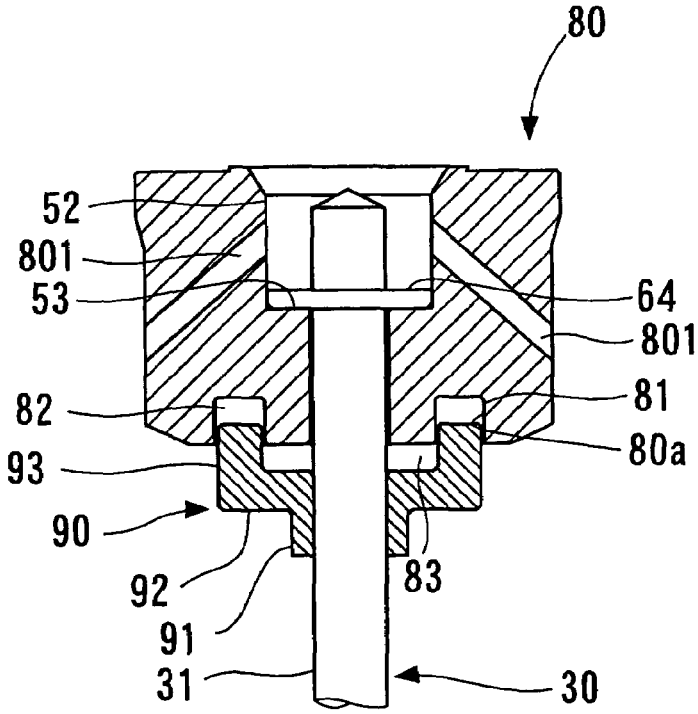
FIG. 7 is a cross-sectional view showing the vicinity around a movable core of an injector according to a third embodiment of the present invention.

The vicinity around the movable core of an injector according to a third embodiment of the present invention is shown in FIG. 7. Those structural elements that are substantially the same as in the first embodiment are given the same reference numerals, and their description is omitted.

As shown in FIG. 7, in a movable core 80 according to the third embodiment, a groove 81 is formed in the end portion at the opposite side from the fixed core 43. The groove 81 is recessed into the movable core 80 in the direction of the fixed core 43. The groove 81 is formed as a continuous ring shape, around the circumferential direction of the movable core 80. Furthermore, a first stop member 90 provided on the needle 30 comprises an inner cylinder portion 91, which is press-fit onto the needle 30, an expansion portion 92, which protrudes radially outward from the inner cylinder portion 91, and an outer cylinder portion 93, which rises from the radial outside edge of the expansion portion 92, towards the fixed core 43 side. The outer cylinder portion 93 is designed to enter the groove 81 of the movable core 80, leaving a slight gap. The movable core 80 comprises fuel passages 801 which connect the inside of the movable core 80 with the outside.

By employing the above construction, a first fuel chamber 82 is formed between the outer cylinder portion 93, and an inner circumferential surface 80*a* that forms the groove 81 within the movable core 80. Furthermore, a second fuel chamber 83 is formed in the space enclosed by the outer cylinder portion 93, the movable core 80, the expansion portion 92, and the needle 30. In other words, in the third embodiment, two fuel chambers, namely the first and second fuel chambers 82 and 83, are formed between the movable core 80 and the first stop member 90.

In the third embodiment, a plurality of fuel chambers 82 and 83 are formed. Consequently, by changing the characteristics of the respective damping effects of the first and second fuel chambers 82 and 83, and combining the resulting effects, the characteristics of the overall damping effect can be easily adjusted as desired.

Figure 8:
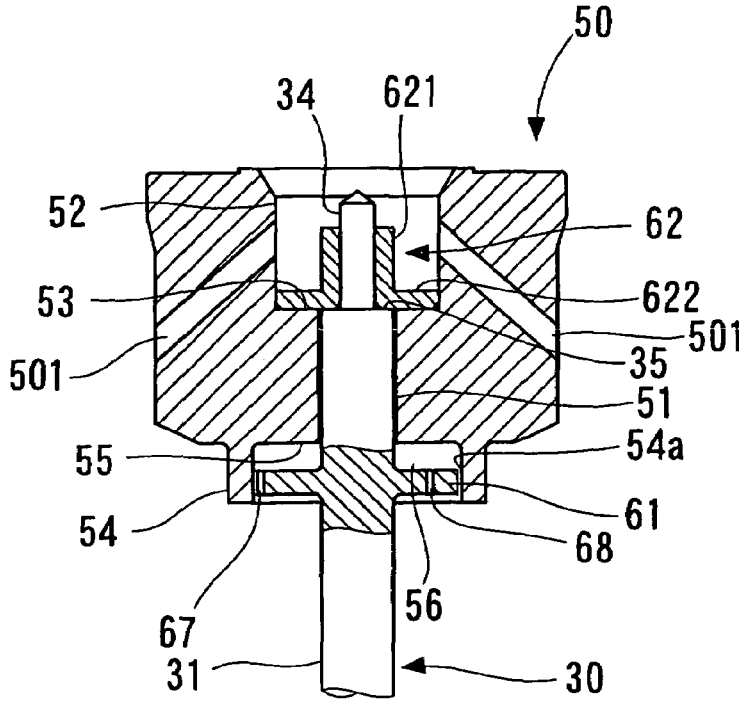
FIG. 8 is a cross-sectional view showing the vicinity around a movable core of an injector according to a fourth embodiment of the present invention.
Figure 9:
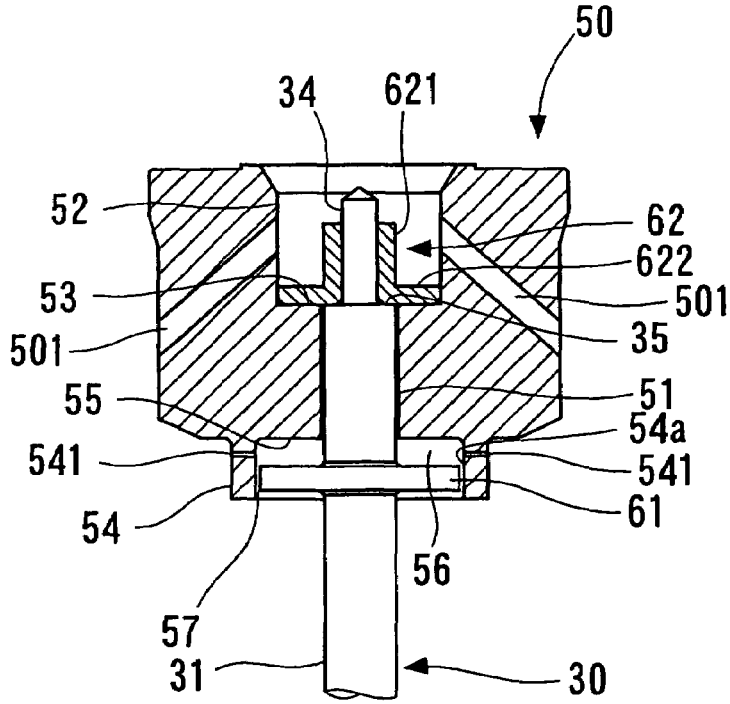
FIG. 9 is a cross-sectional view showing the vicinity around a movable core of an injector according to a fifth embodiment of the present invention.

The vicinity around the movable core of injectors according to fourth and fifth embodiments of the present invention are shown in FIG. 8 and FIG. 9, respectively. Those structural elements that are substantially the same as in the first embodiment are given the same reference numerals, and their description is omitted.

In the description of the first embodiment, an example was presented in which a fuel aperture was formed using the gap between the first stop member and the cylindrical portion. In contrast, in the fourth embodiment, notches 67 are formed in the radial outside edge of the first stop member 61, as shown in FIG. 8. Furthermore, cylindrical holes 68 are also provided, which pass through the first stop member 61 in the through-thickness direction. The notches 67 and the holes 68 constitute the aperture portion described in the claims. Thus, in the fourth embodiment, the notches 67 and the holes 68 act as the aperture portion by which fuel enters and leaves the fuel chamber 56. In the fourth embodiment, by adjusting the shape, number, and size of the notches 67 or holes 68, it is possible to easily adjust the damping characteristics. These notches or holes may also be formed in the second stop member 62 as well as the first stop member 61.

In the fifth embodiment, connecting holes 541 which connect the fuel chamber 56 with the outside of the movable core 50 are formed in the cylindrical portion 54 of the movable core 50, as shown in FIG. 9. In this case, it is possible to easily adjust the damping characteristics by adjusting the shape, number, and size of the connecting holes 541.

Figure 10:
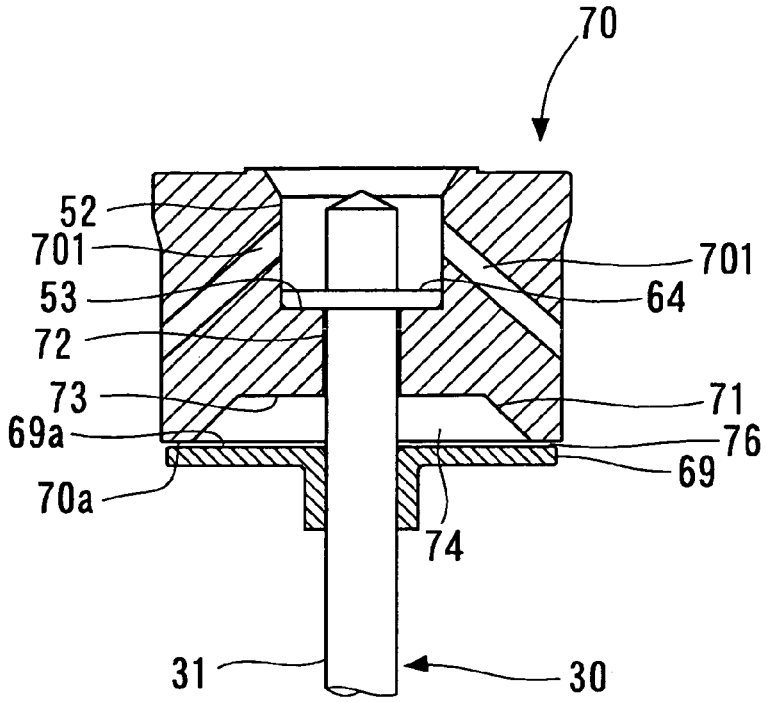
FIG. 10 is a cross-sectional view showing the vicinity around a movable core of an injector according to a sixth embodiment of the present invention.
Figure 11:
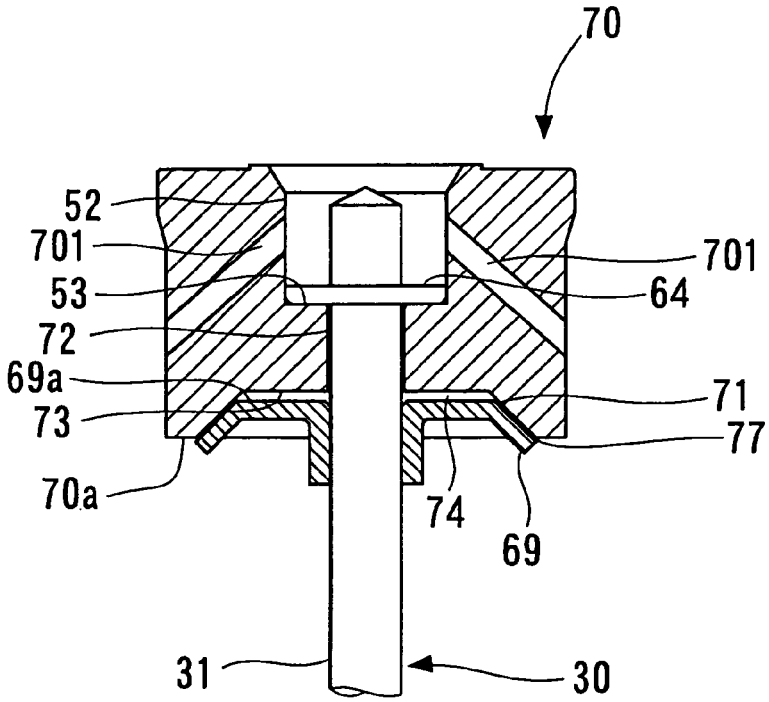
FIG. 11 is a cross-sectional view showing the vicinity around a movable core of an injector according to a seventh embodiment of the present invention.

The vicinity around the movable core of injectors according to sixth and seventh embodiments of the present invention are shown in FIG. 10 and FIG. 11, respectively. Those structural elements that are substantially the same as in the first or second embodiment are given the same reference numerals, and their description is omitted.

The movable core 70 according to the sixth embodiment is a modification of the movable core of the second embodiment. Furthermore, the needle 30 is the same as the modification shown in FIG. 4.

In the sixth embodiment, the recess 71 of the movable core 70 is formed with a tapered shape in which the inside diameter increases with increasing distance from the fixed core 43, as shown in FIG. 10. The inside diameter of the recess 71 on the fixed core 43 side is greater than the inside diameter of the hole portion 72. Consequently, a stepped portion 73 is formed between the recess 71 and the hole portion 72. When the recess 71 is formed with a tapered shape, the first stop member 69, which is formed either integrally with, or separate from, the needle 30, is unable to move inside the recess 71. Furthermore, the outside diameter of the first stop member 69 is greater than the inside diameter of the recess 71 at the opposite end from the fixed core 43, and is only slightly smaller than the outside diameter of the movable core 70. Consequently, in the sixth embodiment, the first stop member 69 moves outside the movable core 70 at the opposite end from the fixed core 43.

During relative movement of the needle 30 and the movable core 70 in the axial direction, the first stop member 69, which is not integrated with the needle 30, moves back and forth in the axial direction outside the movable core 70. At this time, the fuel chamber 74 is formed between the stepped portion 73 of the movable core 70, the inner circumferential surface of the recess 71 of the movable core 70, and an end face 69*a* on the movable core 70 side of the first stop member 69. When axial movement of the needle 30 and the movable core 70 causes the first stop member 69 to move back and forth, the pressure of the fuel in the fuel chamber 74 changes. A gap forms between the end face 70*a* of the movable core 70 on the opposite side to the fixed core 43, and the end face 69*a* on the movable core 70 side of the first stop member 69. Thus, when the pressure of the fuel in the fuel chamber 74 changes, fuel enters and leaves the fuel chamber 74 through the gap formed between the end face 70*a* of the movable core 70 and the end face 69*a* of the first stop member 69. In other words, the end face 70*a* of the movable core 70 and the end face 69*a* of the first stop member 69 form an aperture portion 76 which functions as a fuel aperture for restricting the flow of fuel in and out of the fuel chamber.

In the seventh embodiment, the first stop member 69 is molded to fit the shape of the recess 71 of the movable core 70, as shown in FIG. 11. Thus, in the seventh embodiment, the first stop member 69 is capable of moving back and forth inside the recess 71. In the seventh embodiment, the fuel chamber 74 is formed between the stepped portion 73 of the movable core 70, the inner circumferential surface of the recess 71 in the movable core 70, and the end face 69*a* on the movable core 70 side of the first stop member 69. When movement of the needle 30 and the movable core 70 in the axial direction causes the first stop member 69 to move back and forth inside the recess 71, the capacity of the fuel chamber 74 changes. A gap is formed between the inner circumferential surface of the movable core 70 and the end face 69*a* on the movable core 70 side of the first stop member 69. Thus, when the capacity of the fuel chamber 74 changes, fuel enters and leaves the fuel chamber 74 through the gap formed between the inner circumferential surface of the movable core 70 and the end face 69*a* of the first stop member 69. In other words, the end face 70*a* of the movable core 70 and the end face 69*a* of the first stop member 69 form an aperture portion 77 which functions as a fuel aperture for restricting the flow of fuel in and out of the fuel chamber.

In the sixth and seventh embodiments, the movable core 70 and the first stop member 69 form the fuel chamber 74, and also form the aperture portions 76 and 77. Accordingly, the impact of collisions between the fixed core 43 and the movable core 70 is moderated, while still ensuring that the needle 30 and the movable core 70 move as a unit. Accordingly, bouncing during operation of the needle 30 and the movable core 70 can be reduced.

Furthermore, in the sixth and seventh embodiments, forming the recess 71 in the movable core 70 reduces the mass of the movable core 70. This enables a reduction in the weight of the movable core 70 and the needle 30 that needs to be attracted to the fixed core 43. Accordingly, the responsiveness of the movable core 70 and the needle 30 to changes in the energization of the coil 42 can be improved.

Figure 12:
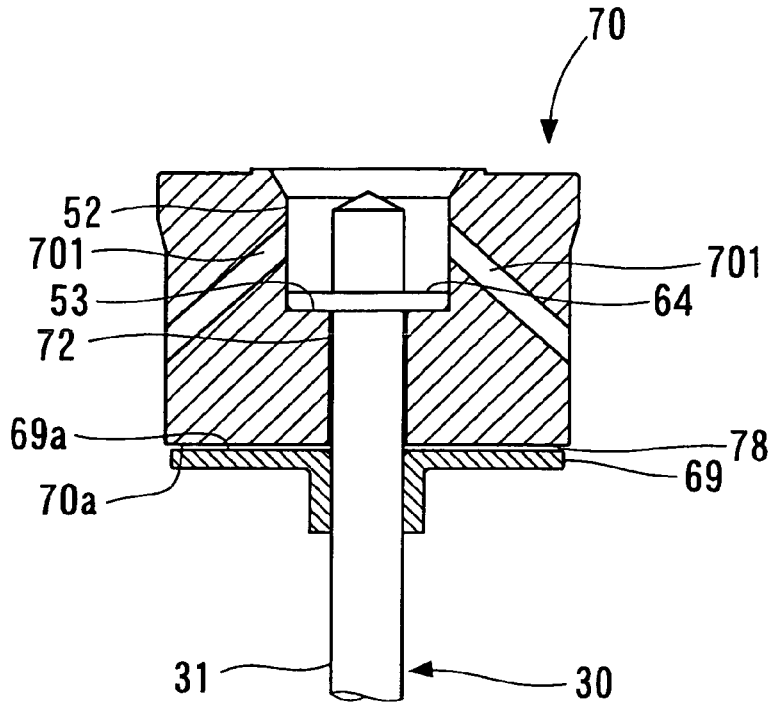
FIG. 12 is a cross-sectional view showing the vicinity around a movable core of an injector according to an eighth embodiment of the present invention.

The vicinity around the movable core of an injector according to an eighth embodiment of the present invention is shown in FIG. 12. Those structural elements that are substantially the same as in the seventh embodiment are given the same reference numerals, and their description is omitted.

In the eighth embodiment, as shown in FIG. 12, there is no recess formed in the end of the movable core 70 on the opposite side from the fixed core 43. In other words, in the eighth embodiment, the movable core 70 has an end face 70*a* on the side of the injection nozzle 23. This end face 70*a* is either substantially perpendicular to the axis of the movable core 70, or may be inclined relative to the axis. The end face 70*a* may also be a stepped surface, or a curved shape. Thus, the movable core 70 forms a fuel chamber between the end face 70*a*, and the end face 69*a* of the first stop member 69 that faces the movable core 70 side. When the movable core 70 and the first stop member 69 move apart, the fuel in this fuel chamber generates a force, that is, a so-called squeezing force, which acts to prevent the movable core 70 and the first stop member 69 from moving apart. Furthermore, when the first stop member 69 and the movable core 70 approach each other, the fuel in this fuel chamber generates a force, that is, a so-called damping force, which acts to hinder the approach of the first stop member 69 and the movable core 70. Thus, when the needle 30 and the movable core 70 move back and forth relative to each other in the axial direction, the fuel in this fuel chamber between the movable core 70 and the first stop member 69 generates a force that hinders the relative movement. This fuel enters and leaves the space between the mutually opposing first stop member 69 and movable core 70 from the radial outside edge. In other words, the end face 70*a* of the movable core 70 and the end face 69*a* of the first stop member 69 form an aperture portion 78 at the radial outside edge, which acts as a fuel aperture for restricting the flow of fuel in and out of the fuel chamber.

In the eighth embodiment, even if a recess is not formed in the end of the movable core 70 on the opposite side to the fixed core 43, a squeezing force and a damping force are still generated by the fuel in the fuel chamber between the movable core 70 and the first stop member 69. As a result, the structure and manufacture of the movable core 70 can be simplified, while still reducing bouncing of the needle 30 and the movable core 70. Furthermore, the amount of fuel which flows into and out of the fuel chamber is controlled by the distance between the end faces 69*a* and 70*a* that form the aperture portion 78. Accordingly, the squeezing force and the damping force that act between the movable core 70 and the first stop member 69 can be controlled easily.

Figure 13:
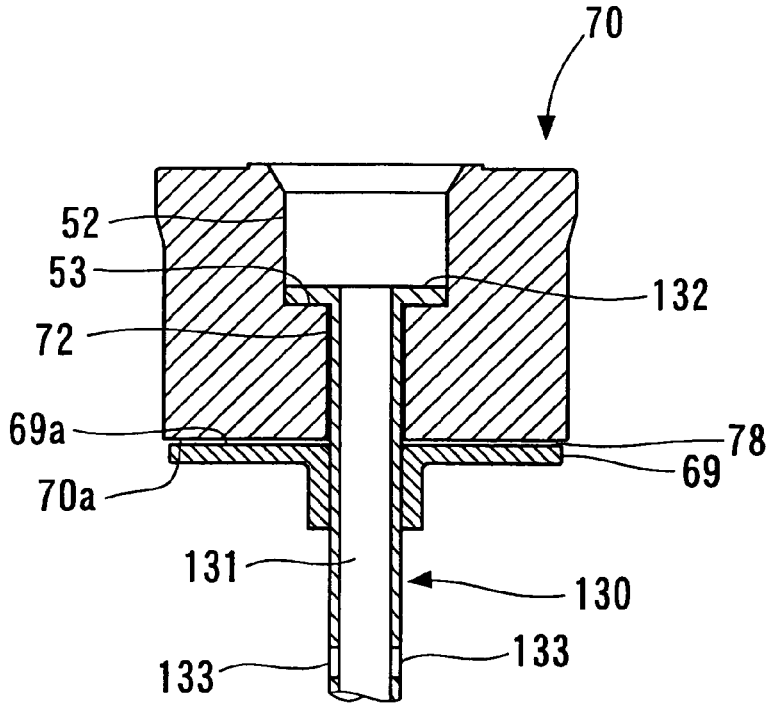
FIG. 13 is a cross-sectional view showing the vicinity around a movable core of an injector according to a ninth embodiment of the present invention.

The vicinity around the movable core area of an injector according to a ninth embodiment of the present invention is shown in FIG. 13. Those structural elements that are substantially the same as in the first embodiment or the eighth embodiment are given the same reference numerals, and their description is omitted.

As shown in FIG. 13, in the ninth embodiment, the movable core 70 is the same shape as in the eighth embodiment. However in the ninth embodiment, the shape of the needle 130 differs from the other embodiments described above. In the ninth embodiment, the needle 130 is formed with a hollow cylindrical shape. As a result, a fuel passage 131 is formed inside the needle 130. The needle 130 has a flange 132, which acts as an end stop member, provided at the opposite end of the needle 130 from the injection nozzle 23. The flange 132 extends radially outward from the needle 130, and is formed as an integral part of the needle 130.

The needle 130 has fuel holes 133, which penetrate the side walls that form the fuel passage 131. The fuel which flows through the fuel passage 131 flows from the inside of the needle 130, through the fuel holes 133, to the outside. Thus, there is no need to form a fuel passage for connecting the inside of the movable core 70 to the outside. The location of the fuel holes 133 is not limited to the movable core 70 side of the needle 130, and they may also be located near the end of the needle 130 on the injection nozzle 23 side. Furthermore, a fuel passage may also be formed in the movable core 70 to ensure an adequate fuel flow rate.

In the ninth embodiment, the needle 130 is formed as a hollow cylinder, thus forming the fuel passage 131. Consequently, the mass of the needle 130 is reduced. This means that the weight of the movable core 70 and the needle 130 that must be attracted to the fixed core 43 can be reduced. Accordingly, the responsiveness of the movable core 70 and the needle 30 to changes in the energization of the coil 42 can be improved.

In the plurality of embodiments described above, the description focused on examples in which two stop members were provided along the axial direction of the needle. However, three or more stop members could also be provided in the axial direction. If, for example, the needle has a plurality of movable cores, each movable core may be sandwiched between two stop members. Furthermore, in the plurality of embodiments above, the description focused on examples in which each embodiment was applied separately. However, a combination of a plurality of embodiments may also be used.

What is claimed is:

1. A fuel injection valve, comprising:

a valve member for opening and closing an injection nozzle;

a first stop member protruding radially outward from said valve member;

a second stop member protruding radially outward from said valve member;

a movable core sandwiched between said first and second stop members, said movable core and one of said first and second stop members defining a fuel chamber;

a fixed core axially displaced from said movable core; and a coil for generating reciprocal axial displacement of said valve member such that said movable core axially reciprocates toward and away from said fixed core therewith.

2. The fuel injection valve according to claim 1, wherein each of said first and second stop members are one of integrally formed with said valve member and separately formed from said valve member.

3. The fuel injection valve according to claim 1, wherein said movable core has a cylindrical portion which protrudes towards said injection nozzle from an end portion on an injection side of said movable core, and said first stop member forms said fuel chamber with said cylindrical portion.

4. The fuel injection valve according to claim 3, wherein an outside radial edge of said first stop member and an inner circumferential surface of said cylindrical portion form a fuel aperture that restricts a flow of fuel entering and leaving said fuel chamber.

5. The fuel injection valve according to claim 3, wherein said first stop member has an aperture portion in a through-thickness direction thereof that restricts a flow of fuel entering and leaving said fuel chamber.

6. The fuel injection valve according to claim 1, wherein said movable core has an injection side recess, recessed away from said injection nozzle, in an end portion at an injection side of said movable core, and said first stop member forms said fuel chamber together with said injection side recess.

7. The fuel injection valve according to claim 6, wherein an outside radial edge of said first stop member and an inner circumferential surface of said injection side recess form a fuel aperture that restricts a flow of fuel entering and leaving said fuel chamber.

8. The fuel injection valve according to claim 6, wherein said first stop member has an aperture portion, which penetrates said stop member in a through-thickness direction, and restricts a flow of fuel entering and leaving said fuel chamber.

9. The fuel injection valve according to claim 1, wherein said movable core has a non-injection side recess, recessed towards said injection nozzle side, in an end portion on an opposite side of said movable core from an injection side, and the second stop member is disposed at an opposite end from said injection nozzle of said valve member and forms said fuel chamber with said non-injection side recess.

10. The fuel injection valve according to claim 9, wherein a base of said movable core that defines said non-injection side recess and opposes said second stop member, and an opposing face of said second stop member, are flat surfaces.

11. The fuel injection valve according to claim 1, wherein said movable core forms said fuel chamber between an injection side end face, and an opposing end face of said first stop member.

12. The fuel injection valve according to claim 11, wherein said injection side end face of said movable core, and said first stop member end face form a fuel aperture, which restricts a flow of fuel entering and leaving said fuel chamber, at an outer edge in a radial direction.

13. The fuel injection valve according to claim 1, wherein said valve member is formed with a cylindrical shape, an inside of which forms a fuel passage.

14. The fuel injection valve according to claim 1, wherein said valve member and said movable core are capable of relative movement in an axial direction.

* * * * *